US010730055B2

(12) United States Patent
Furrer et al.

(10) Patent No.: US 10,730,055 B2
(45) Date of Patent: Aug. 4, 2020

(54) METHOD OF USE OF AGGREGATE PROCESSING EQUIPMENT

(71) Applicant: Johnson Crushers International, Inc., Eugene, OR (US)

(72) Inventors: Tom Furrer, Eugene, OR (US); Gary Heeszel, Eugene, OR (US)

(73) Assignee: Johnson Crushers International, Inc., Chattanooga, TN (US)

( * ) Notice: Subject to any disclaimer, the term of this patent is extended or adjusted under 35 U.S.C. 154(b) by 210 days.

(21) Appl. No.: 16/135,055

(22) Filed: Sep. 19, 2018

(65) Prior Publication Data

US 2019/0083988 A1 Mar. 21, 2019

Related U.S. Application Data

(60) Provisional application No. 62/560,833, filed on Sep. 20, 2017.

(51) Int. Cl.

| | |
|---|---|
| ***B02C 21/02*** | (2006.01) |
| ***B02C 23/12*** | (2006.01) |
| *B02C 2/04* | (2006.01) |

(52) U.S. Cl.

CPC ..... *B02C 23/12* (2013.01); *B02C 21/026* (2013.01); *B02C 2/04* (2013.01)

(58) Field of Classification Search

CPC ..... B02C 21/026; B02C 21/02; B02C 23/12; B02C 2/04

See application file for complete search history.

(56) References Cited

U.S. PATENT DOCUMENTS

| | | | | |
|---|---|---|---|---|
| 3,016,203 | A * | 1/1962 | Sears | B07B 13/16 241/24.1 |
| 6,752,339 | B2 * | 6/2004 | Moriya | B02C 21/026 241/101.74 |
| 9,186,681 | B2 | 11/2015 | Cohen | |
| 10,137,457 | B2 * | 11/2018 | Robinson | B02C 21/026 |
| 2003/0173265 | A1 * | 9/2003 | Cohen | B07B 1/005 209/241 |
| 2010/0193619 | A1 * | 8/2010 | Robinson | B02C 23/08 241/81 |

(Continued)

*Primary Examiner* — Faye Francis

(74) *Attorney, Agent, or Firm* — Chambliss, Bahner & Stophel, P.C.

(57) ABSTRACT

A method for operating an aggregate material processing plant according to two alternative modes of operation. In a first operating mode, unprocessed aggregate material is deposited onto a crusher feed conveyor and then fed to a crusher. The crusher produces crushed aggregate material, which is conveyed by a collection conveyor to a vibratory screen assembly at a first speed. The vibratory screen assembly sizes aggregate material deposited onto an upper screen deck thereof. Unscreened aggregate material is conveyed by a transfer conveyor to the crusher feed conveyor. In a second operating mode, unprocessed aggregate material is deposited onto the vibratory screen assembly, which sizes the aggregate material. The transfer conveyor conveys unscreened aggregate material to the crusher feed conveyor. The crusher feed conveyor feeds aggregate material to the crusher, which produces crushed aggregate material. The collection conveyor conveys crushed aggregate material to the vibratory screen assembly at a second speed.

5 Claims, 5 Drawing Sheets

(56) References Cited

U.S. PATENT DOCUMENTS

| | | | | |
|---|---|---|---|---|
| 2013/0153699 | A1* | 6/2013 | Davis | B02C 21/026<br>241/101.74 |
| 2020/0023376 | A1* | 1/2020 | Venturi | B02C 4/42 |

* cited by examiner

METHOD OF USE OF AGGREGATE PROCESSING EQUIPMENT

CROSS-REFERENCE TO RELATED APPLICATION

This application claims the benefit of U.S. Provisional Patent Application No. 62/560,833, filed on Sep. 20, 2017 and entitled METHOD OF USE OF PORTABLE CRUSHING/SCREENING EQUIPMENT, which is incorporated herein by reference in its entirety.

FIELD OF THE INVENTION

This invention relates generally to a processing plant for crushing, screening and separating aggregate materials. More particularly, the invention relates to a method of using such a processing plant in two alternative modes of operation in order to maximize efficiency.

BACKGROUND OF THE INVENTION

The construction of roadways, parking lots and driveways requires much aggregate material in the nature of crushed stone having various particle sizes. Some of this stone is used for base material and some is combined with asphalt cement to produce asphalt concrete. Still other crushed stone is combined with Portland cement and water for use in constructing concrete pavement and in building construction. Consequently, there is a great demand for crushed stone for use as aggregate materials in paving and building products.

Crushed stone used as aggregate material has three principal functions. It provides a relatively low-cost filler for cement-based products and asphalt concrete. It also provides a mass of particles that will resist the action of applied loads, abrasion, and the percolation of moisture and water. Finally, it minimizes volume changes in the pavement or building product resulting from the setting and hardening process and from moisture and temperature changes. The performance of these functions by the aggregate material depends on the mineral character of the aggregate as related to strength, elasticity and durability, and on the surface characteristics and gradation of the aggregate particles, particularly as related to workability and bonding within a hardened mass, and the density of the product.

Much of the crushed stone used as aggregate materials for roadway and building construction is blasted from quarry walls and processed into various aggregate sizes. Some quarries have permanent processing plants, and others employ portable processing plants for crushing, screening and separating the aggregate materials into various size fractions. In the operation of an open-pit quarry, it is common for holes to be drilled adjacent a wall or face of the quarry pit and for explosive charges to be placed in these holes. The explosives are detonated in order to loosen and remove stone for further processing. A large loader is employed to load off-road trucks with the stone for transport to the processing plant. The stone placed in these off-road trucks will include many large pieces that must be crushed, but it will also include stone that has been reduced to small particulate by the blasting process.

Frequently, an aggregate processing plant will include one or more items of reducing equipment such as jaw crushers, gyratory crushers, cone crushers, vertical shaft impact crushers or horizontal shaft impact crushers. Typically, an aggregate processing plant will also include one or more vibratory and/or grizzly screens to separate the aggregate materials into fractions of varying particle sizes. In addition, an aggregate processing plant will usually include one or more conveyors to transfer aggregate material for processing or to stockpile processed aggregates. Some aggregate processing plants are fixed installations. Others comprise portable processing plants that are mounted on trailers, or on a self-propelled chassis driven by wheeled or track drive systems. Portable processing plants are typically more compact than those comprising fixed installations.

One type of portable processing plant includes a crusher and a crusher feed conveyor to feed material to the crusher. It also includes a crusher collection conveyor under the crusher that delivers crushed material to a vibratory screen assembly, a transfer conveyor for conveying material too large to pass through the vibratory screen assembly to the crusher, and a plurality of discharge conveyors for separating material passing through the screens of the screen assembly. Such a processing plant is typically moved to a suitable location in the quarry for processing of the stone that is delivered by the off-road trucks. However, when the processing plant is loaded with stone obtained from a blasting process, all of the aggregate material, including portions that have already been reduced in particle size, is loaded into the crusher. This causes unnecessary wear on the crusher and reduces the speed at which material is processed. Furthermore, when all of the material is processed through the crusher, the screen assembly must be sized to process material having a top size that is dictated by the top size setting of the crusher.

One conventional way to avoid the unnecessary wear on the crusher incurred when all of the material to be processed is loaded into the crusher is to add a pre-screen component to remove the smaller sized aggregate material that does not need to be processed through the crusher.

It would be desirable, however, if the conventional processing equipment could be altered in such a way that it could be operated without processing all of the aggregate material through the crusher and without the addition of a separate pre-screen component.

Notes on Construction

The use of the terms “a”, “an”, “the” and similar terms in the context of describing the invention are to be construed to cover both the singular and the plural, unless otherwise indicated herein or clearly contradicted by context. The terms “comprising”, “having”, “including” and “containing” are to be construed as open-ended terms (i.e., meaning “including, but not limited to,”) unless otherwise noted. The terms “substantially”, “generally” and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as “connected” and “interconnected”, refer to a relationship wherein structures are secured or attached to one another either directly or indirectly through intervening structures, as well as both moveable and rigid attachments or relationships, unless specified herein or clearly indicated by context. The term “operatively connected” is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiment thereof, and not to place a limitation on the scope of the invention. Nothing in the specification should be construed as indicating any element as essential to the practice of the invention unless so stated with specificity.

SUMMARY OF THE INVENTION

The invention comprises an aggregate processing plant and a method of operation of an aggregate processing plant according to two alternative modes of operation. The preferred aggregate processing plant comprises a crusher feed conveyor, a crusher, a crusher collection conveyor under the crusher that delivers crushed material to a vibratory screen assembly, a transfer conveyor for conveying material too large to pass through the vibratory screen assembly to the crusher, and a plurality of discharge conveyors for separating material passing through the screens of the screen assembly. Preferably, the screen assembly is modified, as compared to a typical conventional screen assembly, to provide a larger screen feedbox or screen infeed section. These modifications also require changing the location of the impulse mechanism of the screen assembly to achieve a weight balance that facilitates a proper vibratory amplitude to be obtained throughout the length of the screen decks. It may also be necessary to increase the space between the top deck of the screen assembly and the crusher collection conveyor in order to account for the additional bounce or projectile height from the larger material being processed by the screen assembly. It may also be necessary to increase the spacing between the screen decks to allow for handling larger sized material. It may also be necessary to provide more screen decks than in a conventional screen assembly. Furthermore, it may be necessary to modify the transfer conveyor and the crusher return conveyor to allow for the handling of larger material. Such material will flow differently than smaller material, because it will have a different angle of repose and a different surcharge angle. It may also be necessary to provide more spacing between the conveyors and other components to allow for handling larger sized material. In some embodiments of the invention, oversized wire mesh, or grizzly bars or a punch plate may be added to protect the screen assembly and conveyors from damage due to the handling of larger sized material. A tramp iron component can be added to the transfer conveyor for conveying material too large to pass through the vibratory screen assembly to the crusher. Such tramp iron component will include a sensor to detect the presence of tramp iron in the material and a diverter to divert such material onto the ground before it enters the crusher.

In another embodiment of the invention, the operating speed of the crusher collection conveyor is varied to control the rate of placement of the crushed material onto the vibratory screen assembly. When loading aggregate material into the crusher feed conveyor according to this embodiment, the crusher collection conveyor is operated at full speed to discharge the crushed aggregate material near the upper end of the screen assembly to get maximum efficiency. When loading aggregate material onto the screen assembly, instead of the crusher feed conveyor, the crusher collection conveyor is operated at a slower speed to discharge crushed aggregate material lower on the screen assembly to relieve the load on and improve the performance of the screen assembly.

In order to facilitate an understanding of the invention, the preferred embodiments of the invention, as well as the best mode known by the inventor for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventor includes all equivalents of the subject matter described herein, as well as various modifications and alternative embodiments such as would ordinarily occur to one skilled in the art to which the invention relates. The inventor expects skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

This description of the preferred embodiments of the invention is intended to be read in connection with the accompanying drawings, which are to be considered part of the entire written description of this invention. The drawings are not necessarily to scale, and certain features of the invention may be shown exaggerated in scale or in somewhat schematic form in the interest of clarity and conciseness.

Figure 1:
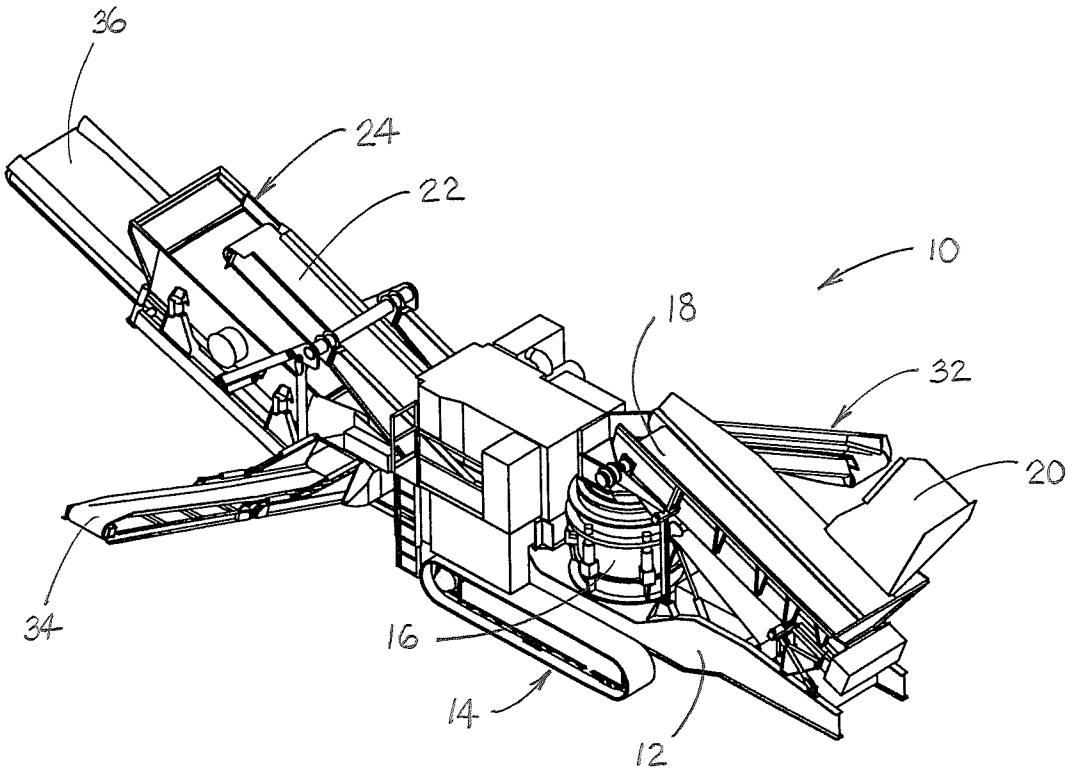
FIGURE 1 (Prior Art)
FIG. 1 is a top perspective view of a conventional portable aggregate processing plant that may be operated according to the method of the invention.
Figure 2:
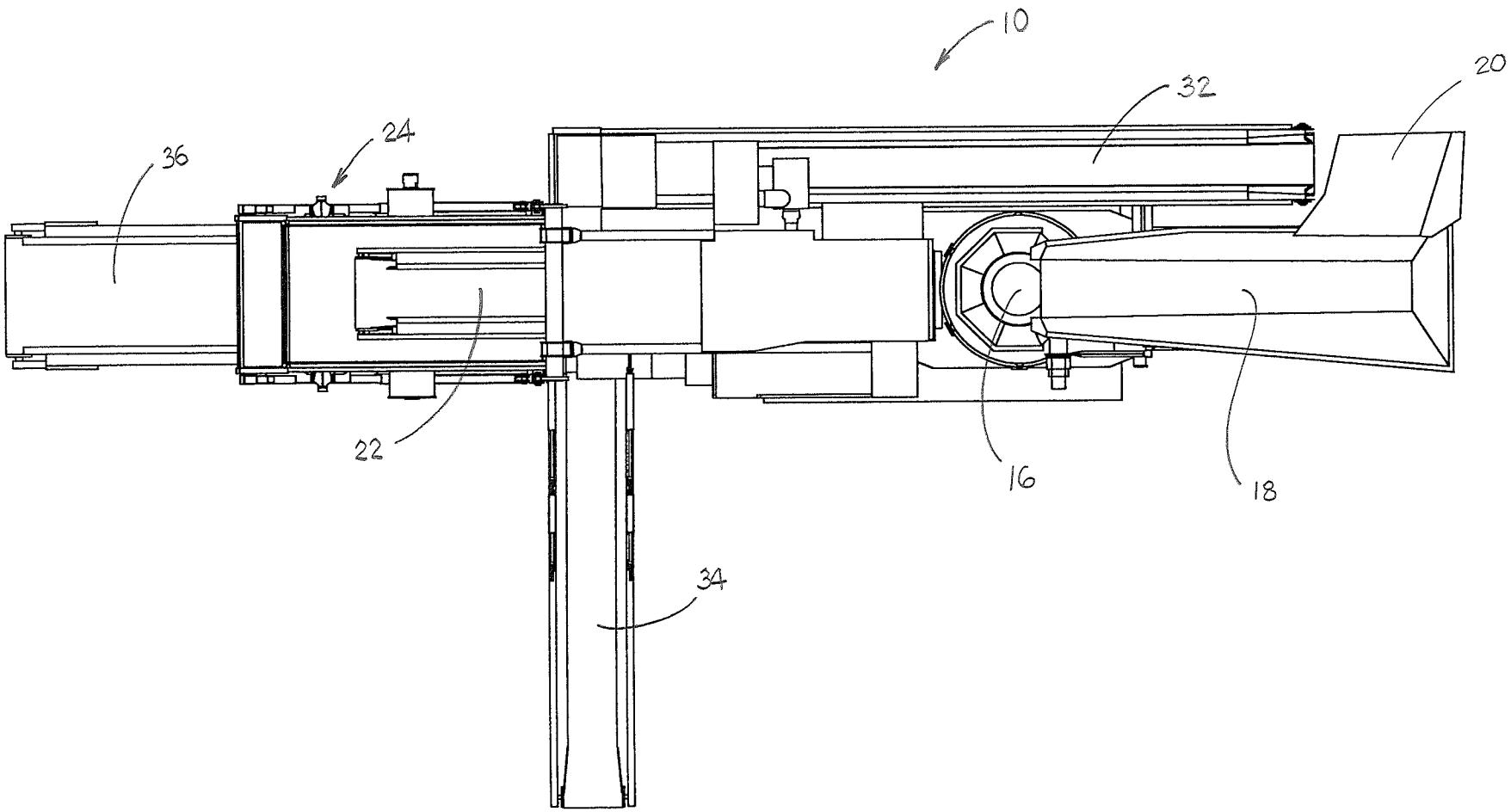
FIGURE 2 (Prior Art)
FIG. 2 is a top view of the portable processing plant shown in FIG. 1.
Figure 3:
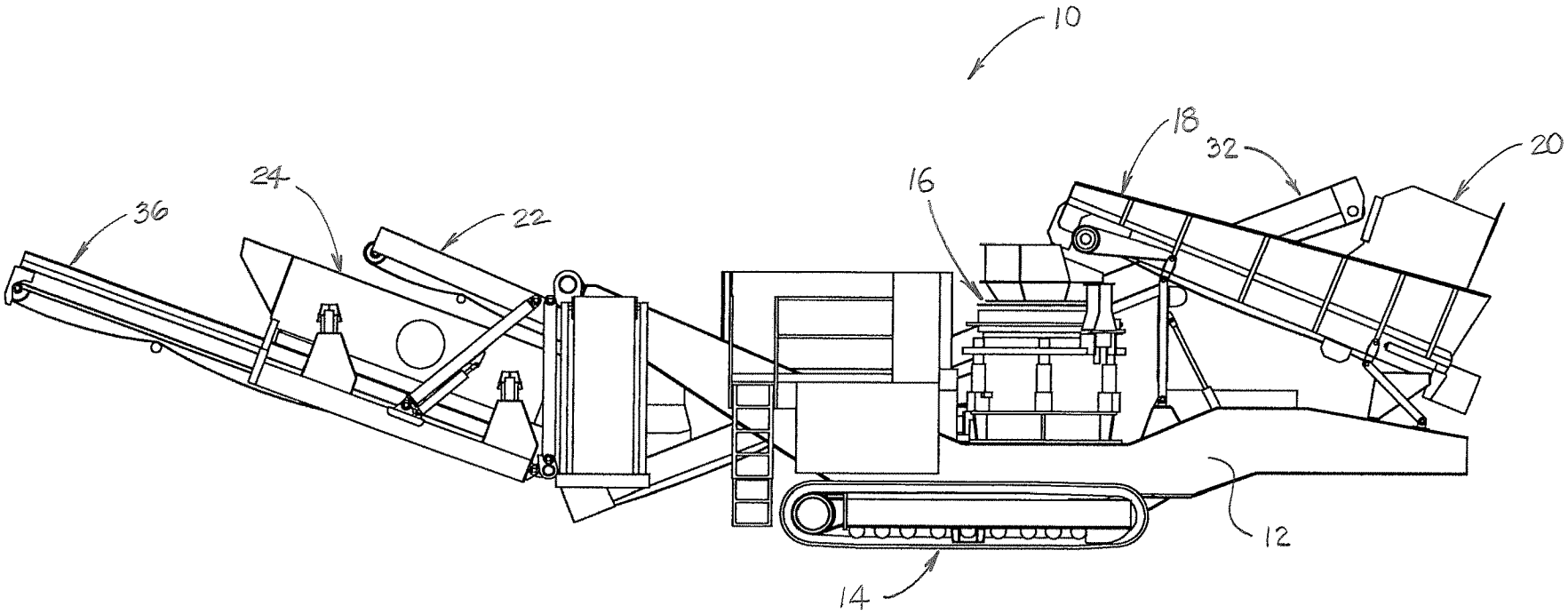
FIGURE 3 (Prior Art)
FIG. 3 is a side view of the portable processing plant shown in FIGS. 1 and 2.

As shown in the drawings, conventional portable processing plant 10 comprises frame 12 which is supported by left and right track drive assemblies, one of which, left track drive assembly 14 is shown in FIGS. 1 and 3. The track drive assemblies are steerable and are typically operated by hydraulic or electric motors. In the alternative, wheeled drive assemblies may be provided comprising left and right front and rear wheel drive assemblies, at least some of which are steerable. Power for operation of the motors that are employed to operate the drive assemblies is usually provided by a diesel engine (not shown), or by local electric power.

A crusher, such as cone crusher 16, is mounted on frame 12 above the drive assemblies. Crusher feed conveyor 18 and feed chute 20 are provided to feed material to be processed into the top of crusher 16. Cone crusher 16 operates to reduce the size of aggregate material introduced through feed conveyor 18 and includes a conventional housing that contains in its upper section a moveable cone (not shown) and a concave or bowl liner (also not shown). The cone is mounted on a crusher shaft (also not shown), and the concave or bowl liner is fixed to the upper part of the crusher housing. Aggregate material to be crushed is fed via feed chute 20 to crusher feed conveyor 18, which drops it into the gap between the cone and the concave or bowl liner of cone crusher 16. This gap is adjustable in width in order to control the top size of material passing through the crusher. The crushing force is produced by an eccentric component, which drives the crushing cone towards the crushing concave or bowl liner in a circular oscillating movement. Due to the friction of the material to be crushed against the cone and concave or bowl liner, the crushing cone moves slowly around the concave in the direction opposite to that of the driving rotation.

Figure 4:
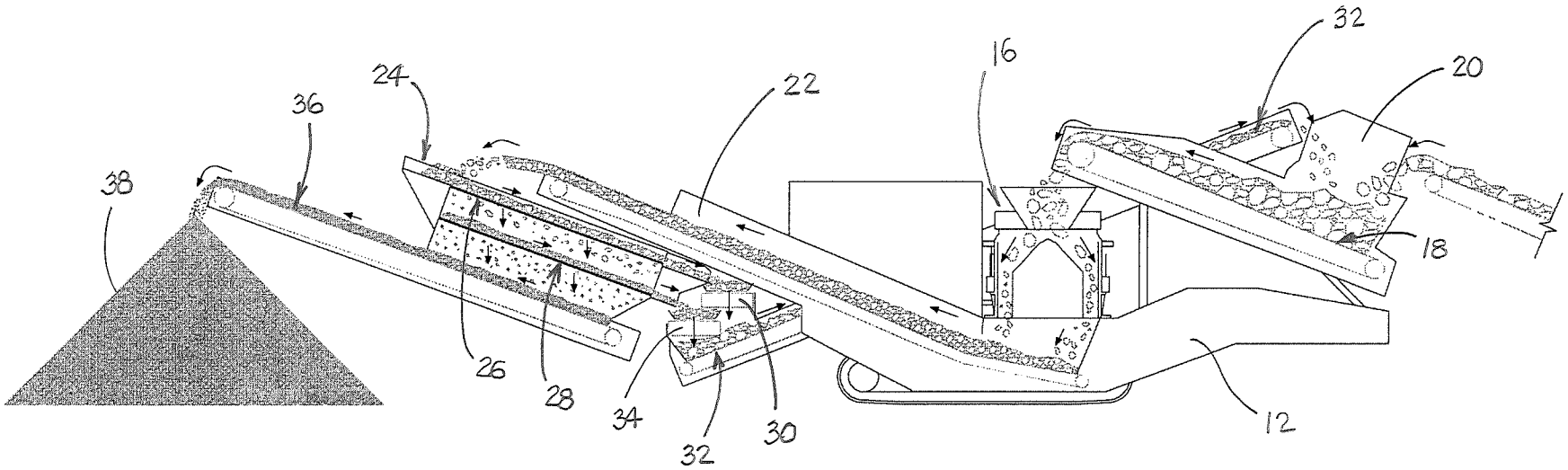
FIG. 4 is a side schematic view of a conventional portable aggregate processing plant such as is illustrated in FIGS. 1-3, showing a first mode of operation according to the method of the invention.
Figure 5:
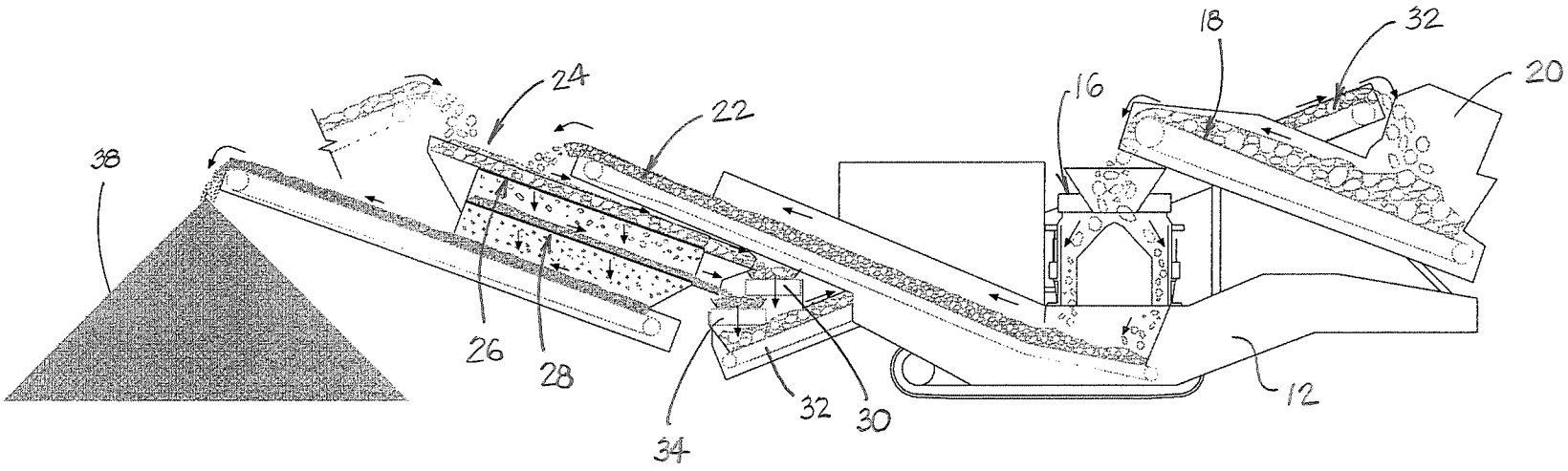
FIG. 5 is a side schematic view of a conventional portable aggregate processing plant such as is illustrated in FIGS. 1-3, showing a second mode of operation according to the method of the invention.

Aggregate material that passes through crusher 16 falls onto crusher collection conveyor 22 that delivers crushed material to vibratory screen assembly 24. Vibratory screen assembly 24 is comprised of upper screen deck 26 and lower screen deck 28 (shown in FIGS. 4 and 5) which are mounted in an inclined configuration. In other embodiments of the invention, only one, or any suitable number of screen decks may be provided. Each screen deck generally comprises sizing media such as woven wire cloth or perforated plates. The sizing media has openings that dictate the largest sized aggregate particle that can pass through the media, and in a screen assembly with multiple screen decks, each screen deck has larger sizing openings than the screen deck located immediately below. An impulse mechanism (not shown) is provided to generate vibrational motion and to impart such motion to the screen decks of screen assembly 24. This vibration is designed to stratify the aggregate material as it flows across the screen decks and to expose the aggregate material particles to the media openings. Aggregate material to be classified by particle size flows across the length of each screen deck and across the sizing media as the impulse mechanism vibrates the screen deck. The vibrations imparted to the screen deck cause material small enough to pass through the openings in the sizing media to pass through to a lower screen deck or transfer conveyor. It also helps to convey the aggregate material across the screen deck and prevents material build-up on the sizing media. Thus, as shown in FIGS. 4 and 5, aggregate material that is retained on upper screen deck 26 (i.e., aggregate material that is too large to pass through the upper screen deck) is carried down to the lower end of deck 26 and off the upper screen deck onto upper transverse conveyor 30, which carries the aggregate material to transfer conveyor 32 which conveys it to feed chute 20. Aggregate material that passes through upper screen deck 26 but is retained on lower screen deck 28 is carried down to the lower end of deck 28 and off the lower screen deck onto transverse discharge conveyor 34, which carries the aggregate material away from machine 10 to a stockpile (not shown). In the alternative, transverse discharge conveyor 34 may be reversed to carry the material to transfer conveyor 32 which conveys it to feed chute 20. Aggregate material that passes through both upper screen deck 26 and lower screen deck 28 falls onto longitudinal discharge conveyor 36 for transport to stockpile 38.

The invention comprises a method of operation of aggregate processing plant 10 according to two alternative modes of operation. According to the invention, the operating speed of crusher collection conveyor 22 is varied, between a first speed and a second speed which is less than the first speed, to control the rate of placement of the crushed material onto vibratory screen assembly 24. When loading aggregate material only into crusher feed conveyor 18, as shown in FIG. 4, crusher collection conveyor 22 is operated at the first speed to discharge the crushed aggregate material near the upper end of screen assembly 24 to get maximum efficiency. When loading unprocessed aggregate material onto vibratory screen assembly 24 instead of crusher feed conveyor 18, as shown in FIG. 5, crusher collection conveyor 22 is operated at the second speed to discharge crushed aggregate material lower on the vibratory screen assembly to relieve the load on and improve the performance of the screen assembly.

The invention thus provides a method of operation of an aggregate processing plant according to two alternative modes of operation, which does not require processing all of the aggregate material through the crusher of the processing plant or the addition of a pre-screen component.

Although this description contains many specifics, these should not be construed as limiting the scope of the invention but as merely providing illustrations of some of the presently preferred embodiments thereof, as well as the best mode contemplated by the inventor of carrying out the invention. The invention, as described and claimed herein, is susceptible to various modifications and adaptations as would be appreciated by those having ordinary skill in the art to which the invention relates.

What is claimed is:

1. A method for operating an aggregate material processing plant according to first and second alternative modes of operation, said method comprising the steps of:

(a) providing an aggregate material processing plant comprising:
  (i) a crusher;
  (ii) a crusher feed conveyor that is adapted to feed aggregate material to the crusher;
  (iii) a vibratory screen assembly comprising an upper screen deck;
  (iv) a collection conveyor that is adapted to collect aggregate material that has passed through the crusher and to convey such crushed aggregate material to the vibratory screen assembly at a first speed or at a second speed which is slower than the first speed;
  (v) an upper transverse conveyor that is adapted to collect aggregate material that is too large to pass through the upper screen deck and to convey such un-screened aggregate material away from the vibratory screen assembly;
  (vi) a transfer conveyor that is adapted to collect un-screened aggregate material that has been conveyed away from the vibratory screen assembly by the upper transverse conveyor and to convey such un-screened aggregate material to the crusher feed conveyor;

(b) wherein the first mode of operation of the method comprises:
  (i) depositing unprocessed aggregate material onto the crusher feed conveyor;
  (ii) operating the crusher feed conveyor to feed aggregate material to the crusher;
  (iii) operating the crusher to produce crushed aggregate material;
  (iv) operating the collection conveyor to convey crushed aggregate material to the vibratory screen assembly at the first speed;

(v) operating the vibratory screen assembly to size aggregate material that has been deposited onto the upper screen deck;

(vi) operating the transfer conveyor to convey unscreened aggregate material to the crusher feed conveyor;

(c) wherein the second mode of operation of the method comprises:

(i) depositing unprocessed aggregate material onto the vibratory screen assembly;

(ii) operating the vibratory screen assembly to size aggregate material that has been deposited onto the upper screen deck;

(iii) operating the transfer conveyor to convey unscreened aggregate material to the crusher feed conveyor;

(iv) operating the crusher feed conveyor to feed aggregate material to the crusher;

(v) operating the crusher to produce crushed aggregate material;

(vi) operating the collection conveyor to convey crushed aggregate material to the vibratory screen assembly at the second speed.

2. The method of claim 1 wherein the second mode of operation comprises simultaneously depositing unprocessed aggregate material onto the vibratory screen assembly and onto the crusher feed conveyor.

3. The method of claim 2 wherein the second mode of operation comprises depositing unprocessed aggregate material onto a first portion of the vibratory screen assembly; and operating the collection conveyor to convey crushed aggregate material to a second portion of the vibratory screen assembly.

4. The method of claim 2 wherein the unprocessed aggregate material onto the vibratory screen assembly is smaller in size than the unprocessed aggregate material deposited onto the crusher feed conveyor.

5. The method of claim 1 further comprising the steps of:

providing a mobile aggregate material processing plant; and moving the mobile aggregate material processing plant to an aggregate material processing location.

* * * * *